United States Patent [19]

Brush, Sr. et al.

[11] Patent Number: 4,508,406

[45] Date of Patent: Apr. 2, 1985

[54] ELECTRICAL CONNECTOR ASSEMBLY HAVING AN ANTI-DECOUPLING DEVICE

[75] Inventors: Robert W. Brush, Sr., Unadilla; Dee A. Werth, Afton, both of N.Y.

[73] Assignee: Allied Corporation, Morristown, N.J.

[21] Appl. No.: 431,971

[22] Filed: Sep. 30, 1982

[51] Int. Cl.[3] ..... H01R 13/623

[52] U.S. Cl. ..... 339/89 M; 339/DIG. 2

[58] Field of Search ..... 339/89 R, 89 C, 89 M, 339/90 R, 90 C, DIG. 2; 285/81, 82, 86; 411/299

[56] References Cited

U.S. PATENT DOCUMENTS 4,239,314 12/1980 Anderson et al. ..... 285/82
4,291,933 9/1981 Kakaris ..... 339/89 R
4,359,254 11/1982 Gallusser et al. ..... 339/89 M
4,407,529 10/1983 Holman ..... 339/89 R

FOREIGN PATENT DOCUMENTS 1389839 1/1965 France ..... 339/89 M

*Primary Examiner*—John McQuade
*Attorney, Agent, or Firm*—C. D. Lacina

[57] ABSTRACT

A coupling nut (300) including a radial flange (305) having a plurality of angularly disposed spring housings (315), each spring housing for receiving therewithin a cantilevered spring arm (400) having one end secured (402) within an annular undercut (303) circumjacent the flange and the other end (401) disposed within ratchet teeth (105) and free to radially deflect in the spring housing (315) as a result of the radial flange being rotated, rotation against the ratchet teeth camming the spring arm against forward and rearward faces (106, 108) of the succession of peaks and valleys formed by the ratchet teeth around an annular shoulder (140) of a connector shell (100) to which the nut (300) is mounted for rotation.

13 Claims, 5 Drawing Figures

FIG. 1
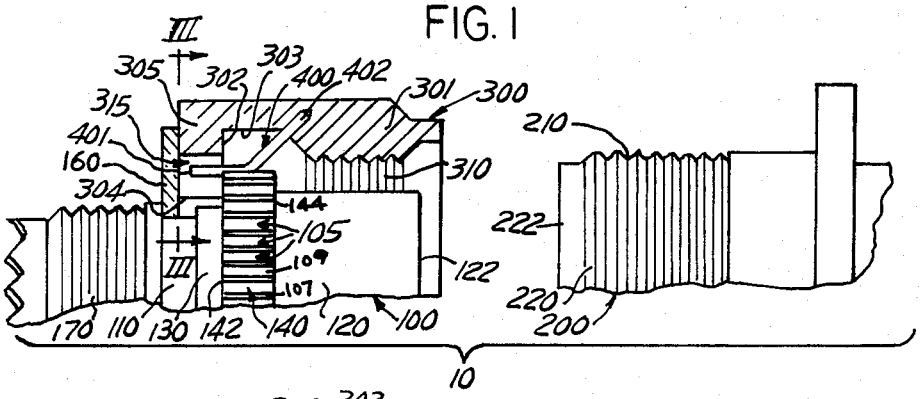
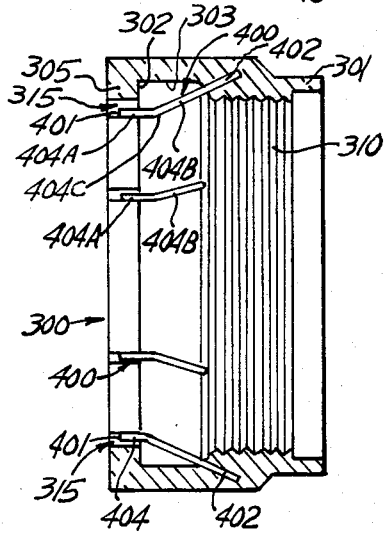
FIG. 2
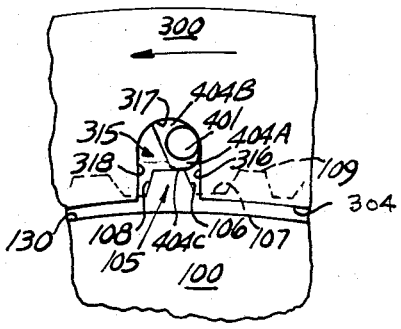
FIG. 5
FIG. 3
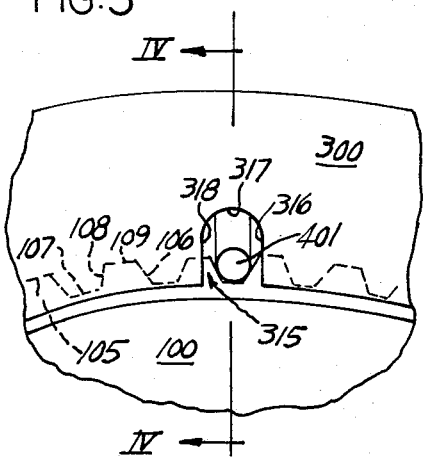
FIG. 4
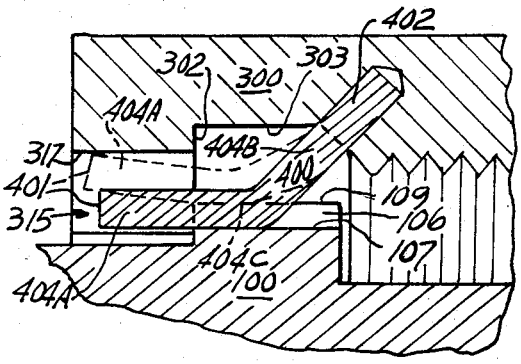

ELECTRICAL CONNECTOR ASSEMBLY HAVING AN ANTI-DECOUPLING DEVICE

This invention relates to an electrical connector having an anti-decoupling device and more particularly to a coupling nut having a plurality of radially deflectable cantilever type spring arms adapted to engage with ratchet teeth formed on the connector assembly for retarding uncoupling rotation of the coupling nut relative to the electrical connector assembly.

Electrical connector assemblies are generally comprised of two separate but interconnectable cylindrical shells, one shell mounting electrical contacts therein mateable with electrical contacts in the other shell when the shells are connected together by a tubular coupling member. The coupling member is rotatably mounted to one of the shells by a retaining ring positioned to captivate an inward radial flange of the coupling member adjacent an annular shoulder having a plurality of ratchet teeth formed circumferentially about the shell. Complementary external thread on the other shell and internal thread on the coupling member are adapted to engage and allow the connector shells to couple/uncouple depending upon the direction of rotation.

The coupled relation is maintained by friction forces between the thread. However, if vibrated, the joint between the threads may uncouple. "Electrical Connector Assembly Having Anti-Decoupling Mechanism" U.S. Pat. No. 4,109,990 issuing Aug. 29, 1972 to Waldron et al mounted a straight spring beam to the coupling nut for engaging the circumferentially disposed ratchet teeth. While suitable for the purposes intended, this mounting constantly biases the spring beam into contact with the ratchet teeth at all rotational positions of the coupling nut. However, a loaded spring beam has a tendency to fatigue and relax with time and thus decoupling resistance would deteriorate if the beam is constantly under a load.

Accordingly, this invention provides a coupling nut having a radial flange and rotatably mounted to a connector shell with a anti-decoupling device, the anti-decoupling device comprising at least one elongated, longitudinally extending, spring arm having one end thereof immovably secured to the coupling nut and its other end free and extending radially inwardly therefrom, the spring arm being resiliently radially deflectable about its securement and comprising the free end having adjacent thereto a hooked end portion disposed in a valley formed between successive ratchet teeth formed around the shell, rotation of the coupling nut driving the hooked portion against the tooth face and radially deflecting the hooked portion upwardly from its valley and over the peak into the next successive valley. An end wall of the radial flange is provided with a spring housing for protecting the hooked end portion and for bearing against the hooked portion, the spring housing being a U-shaped opening cut into the flange including radially extending, angularly spaced, forward and rearward sidewalls and a radial limit wall, the sidewalls being adapted to engage and force the hooked portion against successive ratchet teeth which radially deflect and can the hooked end portion upwardly and the free end into engagement with the radial limit wall which compresses the hooked end portion and allows the hooked portion to pass over the peak.

An advantage of the present invention is that the spring arm, deflecting from one ratchet tooth valley and into the next valley, provides a resistance sufficient to impede unwanted uncoupling rotation but insufficient to prevent wanted coupling/uncoupling rotation by the user.

Another advantage of the present invention is that rotational resistance may be increased by increasing the number of spring arms on the coupling nut.

Another advantage of the present invention is that a spring arm need not be maintained in constant bias condition and in compression with ratchet teeth when not being rotated.

One way of carrying out the invention is described in detail below with reference to the drawings which illustrate one specific embodiment of the invention, in which:

FIG. 1 illustrates an elevation view partially in section of a coupling nut for an electrical connector assembly including an anti-decoupling device.

FIG. 2 is a sideview, in section, of the coupling nut according to this invention.

FIG. 3 is a partial end view of the coupling nut taken along lines III—III of FIG. 1.

FIG. 4 is a partial elevation view in section of the coupling nut taken along lines IV—IV of FIG. 3.

FIG. 5 is a partial end view, much like FIG. 3, showing some rotation of the coupling nut relative to the connector assembly.

Referring now to the drawings, FIG. 1 illustrates an uncoupled electrical connector assembly 10 in position for mating and comprises generally cylindrical first and second shells 100, 200 and a coupling nut 300 rotatably mounted to the first shell 100 for connecting the second shell 200 with the first shell 100 in mating relationship and including and anti-decoupling device.

The first shell 100 is a plug electrical connector and includes a front portion 120 having a front face 122, a rear portion 170 and an annular shoulder 140, the rear portion 170 including a stepped groove 110 and an annular wall 130, the annular shoulder 140 having forward and rearward faces 144, 142 and extending medially around the outer periphery of the plug shell. The second shell 200 is a receptacle electrical connector and includes a front portion 220 having front face 222 and an exterior portion thereof provided with thread 210. Each of the shell forward portions 120, 220 are adapted to telescopically interfit with one another with the plug shell 100 being drawn within the receptacle shell 200. The outer surface of annular shoulder 140 includes a plurality of radial, longitudinally extending, ratchet teeth 105, the teeth being contiguous and defining a succession of longitudinally extending peaks 109 and valleys 107.

Although not shown, the shells 100, 200 would each include one or more electrical contacts for mating retained by a suitable dielectric insert mounted therewithin and a key in one shell would be received in a keyway in the other shell for orienting the shells 100, 200 for mating.

The coupling nut 300 includes a cylindrical forward portion 301 having thread 310 and an inwardly extending radial flange 305, the radial flange having an end wall 302 and a circumferential face 304, the coupling nut being received over rear portion 170 of first shell 100 such that the end wall 302 of radial flange 305 is circumjacent rearward face 142 of annular shoulder 140, the internal thread 310 being adapted to mate with the external thread 210 on second shell 200 to draw the first and second shells 100, 200 together with the contacts mated as a result of the coupling nut being rotated.

A retaining ring 160 is adapted to be snapped into the stepped groove 110 for captivating the radial flange 305 against the annular shoulder 140 for rotation thereadjacent and for limiting the axial movement of the assembled coupling nut relative to the first shell 100.

Preferably and in accord with this invention, coupling nut 300 includes an interior annular undercut 303, a plurality of resiliently radially deflectable spring arms 400 and a plurality of spring housings 315 for protecting and limiting deflection of the spring arms, undercut 303 being disposed circumjacent end wall 302 and in circumposing relation to ratchet teeth 105, each spring arm 400 has one end 402 thereof mounted to undercut 303 and a free end 401 extending inwardly therefrom, a hooked end portion 404 of the spring arm being received within a spring housing and engaged within the ratchet teeth, the rotational engagement of the spring arm against ratchet teeth deflecting the ratchet hooked end portion and resisting rotation.

FIG. 2 shows spring arms 400 depending as cantilevers from annular undercut 303 of coupling nut 300, each spring arm 400 having its first end 402 immovably secured to annular undercut 303 and its hooked end portion 404 disposed within its respective spring housing 315, the hooked end portion extending radially inward and longitudinally rearward from the undercut to its deflectable free end 401. Each spring arm 400 is preferably one piece, cylindrical in cross-section with hooked end portion 404 including substantially straight first and second arm portions 404A, 404B, the first arm portion 404A being axially extending and parallel to the axis of rotation, second arm portion 404B being at an acute angle to the axis of rotation and the arm portions 404A, 404B being interconnected at adjacent ends to define a knee portion 404C forming an obtuse angle therebetween.

Radial flange 305 of coupling nut 300 includes a plurality of spring housings 315 adapted to receive a spring arm 400, each spring housing 315 being adapted to protect and bear against the axially extending first arm portions 404A of hooked end portion 404.

FIG. 3 shows an end view of coupling nut 300 with circumferential face 304 thereof being clearance fit about annular wall 130 of first shell 100. The free end 401 of hooked end portion 404 is protected within spring housing 315 and disposed within a valley 107 formed between faces 106, 108 of adjacent ratchet teeth 105. Each spring housing 315 is generally U-shaped and includes angularly separated, radially extending, forward and rearward sidewalls 316, 318 and a radial limit wall 317. In a preferable embodiment, six spring arms 400 are received in respective spring housings 315, although more or fewer spring arms could be utilized depending upon the resistance to uncoupling rotation desired. The sidewalls limit lateral sway of the spring arms and assure controlled bias of the spring arm against ratchet teeth for resisting uncoupling rotation.

The plurality of ratchet teeth 105 are disposed around annular shoulder 140 and generally equiangularly spaced arrangement to define a succession of contiguous peaks and valleys formed by confronting faces of the ratchet teeth. With respect to the axis of rotation of the coupling nut, ratchet teeth 105 are longitudinally extending and each of the teeth include generally flat peaks and valleys 109, 107, forward face 106 representing a coupling direction and a rearward face 108 representing an uncoupling direction, the forward and rearward faces 106, 108 being formed at different angles relative to a radius drawn from the axis of rotation of the coupling nut 300, forward face 106 being inclined at a relatively large (i.e. steep) angle thereto for ease of coupling rotation and rearward face 108 being inclined at a relatively small (i.e. shallow) angle thereto for resistance to uncoupling rotation.

FIG. 4 shows an enlarged section view of the relationship between spring arm 400, spring housing 315 and ratchet teeth 105. Deflectable free end 401 is extending into spring housing 315 and axially extending first arm portion 404A of hooked end portion 404 is disposed in biased engagement with the ratchet teeth. As a result of rotation and shown by the phantom lines, free end 401 is deflected radially upwardly from engagement with valley 109 of the ratchet teeth and into engagement with radial limit wall 317, the peak 109 of one ratchet tooth and radial limit wall 317 serving to slightly flatten the first and second arm portions 404A, 404B of spring arm 400 relative to one another in the longitudinal direction relative to knee portion 404C.

FIG. 5 shows coupling nut 300 rotated slightly relative to first shell 100 of the electrical connector assembly and spring arm 400 advanced against forward face 106. As a result of this rotation, forward face 106 of the ratchet tooth cams hooked end portion 404 radially upwardly whereupon deflectable free end 401 is driven against the radial limit wall 317 to deform spring arm 400 (shown by the phantom lines in FIG. 4), the first arm portion 404A being positioned between a tooth peak 109 and a radial limit wall 317. Further rotation would cause the spring arm 400 to advance beyond the peak and to resiliently snap back into the next successive valley.

As the coupling nut is rotated the sidewalls 316, 318 engage and drive hooked portion 404 against the respective faces of the ratchet teeth which, in turn, cam the hooked portion radially outward of the valley and the free end 401 against radial limit wall 317, radial limit wall 317 bearing against free end 401 of the spring arm and peak bearing against knee portion 404C.

Although the description of this invention has been given with reference to a particular embodiment, it is not to be construed in any limiting sense. Many variations and modifications may occur to those skilled in the electrical connector art. Coupling nut 300 could be comprised of a suitable plastic material and spring arms 400, although shown as having a generally cylindrical cross-section and pin shaped, could also be provided with a cross-section more closely matching that defined by the forward and rearward faces of the ratchet teeth, such as being somewhat trapezeodial.

We claim:

1. An electrical connector assembly having an anti-decoupling device comprising: first and second shells, one of said shells including on an outside portion thereof a plurality of radially extending ratchet teeth, said ratchet teeth forming a contiguous succession of peaks and valleys between, respectively, first and second cam faces; a coupling nut mounted for rotation to the first shell for connecting to the second shell and coupling the first and second shells together; and an anti-decoupling device for retarding rotational movement of the coupling nut relative to the first and second shells, said anti-decoupling device characterized by:

an elongated spring arm having its axis extending generally in the direction of the connector axis one end thereof being secured to the inside of the coupling nut and its other end extending therefrom and disposed in one said valley, said spring arm being constrained to rotate with said coupling nut and resiliently deflectable in a radial direction relative to its securement and said other end being adapted to radially deflect and advance from one to another of said valleys, rotation of the coupling nut forcing the other end of the spring arm against one of said cam faces, the cam face camming the other end radially upwardly from the one valley and over the peak associated therewith and into the next successive valley, rotational engagement of the spring arm with the ratchet teeth faces retarding rotational movement.

2. The electrical connector assembly as recited in claim 1, wherein said spring arm includes an axially extending first arm portion adjacent said other end and is disposed in the valley, wherein said coupling nut includes a radial flange having a spring housing for receiving and bearing against said first arm portion, the spring housing comprising, respectively, radially extending forward and rearward sidewalls and a radial limit wall, said sidewalls being adapted to engage and force said first arm portion against the successive ratchet teeth cam faces, the sidewalls and cam faces coacting to cam the first arm portion radially upward from the tooth valley to the tooth peak with radially upward deflection of the first arm portion being limited by the radial limit wall engaging the deflected other end, the radial limit wall and the peak coacting to distort the spring arm.

3. The electrical connector assembly as recited in claim 2, characterized in that a plurality of spring housings are disposed in said radial flange and a like plurality of resiliently radially deflectable spring arms are secured to said coupling nut, each said spring arm having its respective first arm portion disposed in respective ratchet teeth.

4. The electrical connector assembly as recited in claim 3, wherein said radial flange includes an end wall and a circumferential face and said forward portion, and said coupling nut includes an annular undercut circumjacent said end wall thereof, said circumferential face being circumposed about the first shell and said spring arms depending from said annular undercut.

5. The electrical connector assembly as recited in claim 4, wherein six spring arms extend radially inwardly from said coupling nut, each said spring arm being generally equiangularly disposed around said annular undercut.

6. The electrical connector assembly as recited in claim 1, wherein an annular flange extends radially outward from said first shell, said ratchet teeth are generally equiangularly disposed about the annular flange with their respective peaks and valleys being parallel to the axis of rotation, and said spring arm extends longitudinally rearward from its secured end.

7. The electrical connector assembly as recited in claim 2, characterized in that said spring arm includes said first arm portion and a substantially straight second arm portion, said second arm portion being disposed at an acute angle to the axis of rotation and including the secured end, and said first and second arm portions having their adjacent ends connected.

8. The electrical connector assembly as recited in claim 7, characterized in that said spring arm is one piece.

9. A coupling nut for an electrical connector including an annular shoulder disposing a successive plurality of peaks and valleys therearound, said coupling nut comprising a tubular portion having a central axis and an inward radial flange adapted to be captivated against the annular shoulder, said coupling nut characterized by:

an annular undercut disposed in the tubular portion circumjacent the radial flange;

at least one radial slot disposed within said radial flange; and at least one elongated cantilever spring arm fixedly secured to said coupling nut and with its axis extending generally in the axial direction of the tubular portion rearwardly and radially inward from said annular undercut, said spring arm being resiliently deflectable radially inwardly and outwardly from the central axis and having an axially extending first arm portion received in said radial slot and normally biased within one said valley.

10. The coupling nut according to claim 9, characterized in that a plurality of cantilever spring arms are received in a respective plurality of radial slots generally equiangularly disposed around the coupling nut.

11. The coupling nut according to claim 10, wherein the coupling nut is comprised of a plastic material.

12. A coupling member for use with an electrical connector including an annular shoulder having a plurality of teeth around its outer periphery, said coupling member comprising:

a tubular sleeve mounted to said connector and including a radial flange having an end wall;

a radially extending U-shaped slot formed in said radial flange; and a resiliently deflectable elongated spring having its axis extending generally in the direction of the axis of the tubular sleeve with one end of the spring being fixedly secured to said sleeve and its other end extending axially rearward therefrom and radially inward into the U-shaped slot in said radial flange.

13. The coupling member as recited in claim 12, wherein the spring includes a straight first portion disposed in parallel relation with the axis of the tubular sleeve and a straight second portion extending at an acute angle from the coupling member.

* * * * *